US005839593A

United States Patent [19]

McKedy

[11] Patent Number: 5,839,593

[45] Date of Patent: Nov. 24, 1998

[54] OXYGEN ABSORBING CONTAINER CAP LINER

[75] Inventor: George E. McKedy, Williamsville, N.Y.

[73] Assignee: Multiform Desiccants, Inc., Buffalo, N.Y.

[21] Appl. No.: 892,014

[22] Filed: Jul. 14, 1997

Related U.S. Application Data

[63] Continuation of Ser. No. 695,542, Aug. 12, 1996, abandoned, which is a continuation-in-part of Ser. No. 471,573, Jun. 6, 1995, abandoned.

[51] Int. Cl.[6] ..... B65D 53/04

[52] U.S. Cl. ..... 215/349; 215/350; 215/341; 428/34.5; 428/35.7; 428/36.4; 428/349; 426/118

[58] Field of Search ..... 215/347, 348, 215/349, 350, 341; 428/35.7, 36.91, 36.9, 36.4, 283, 349, 34.5; 206/204, 484, 484.1, 484.2, 118, 0.7; 426/118

[56] References Cited

U.S. PATENT DOCUMENTS

| | | | |
|---|---|---|---|
| 96,871 | 11/1869 | Blanchard | 426/546 |
| 2,055,625 | 9/1936 | Heckel et al. | 215/347 |
| 2,072,536 | 3/1937 | Trickey et al. | 215/349 |
| 3,695,477 | 10/1972 | Edmonston et al. | 215/341 |
| 3,866,845 | 2/1975 | Keeler et al. | 215/341 |
| 4,128,185 | 12/1978 | Wszolek | 215/349 |
| 4,151,924 | 5/1979 | Jameson | 215/347 |
| 4,279,350 | 7/1981 | King | 215/228 |
| 4,287,995 | 9/1981 | Moriya | 215/228 |
| 4,485,133 | 11/1984 | Ohtsuka et al. | 206/0.7 |
| 4,487,179 | 12/1984 | Komatsu et al. | 206/0.7 |
| 4,510,162 | 4/1985 | Nezat | 426/124 |
| 4,667,814 | 5/1987 | Wakamatsu et al. | 206/0.7 |
| 4,740,402 | 4/1988 | Maeda et al. | 428/35.9 |
| 4,785,952 | 11/1988 | Obadia | 215/347 |
| 5,089,323 | 2/1992 | Nakae et al. | 428/220 |
| 5,143,763 | 9/1992 | Yamada et al. | 428/36.5 |
| 5,239,016 | 8/1993 | Cochran et al. | 525/371 |
| 5,274,024 | 12/1993 | Koyama et al. | 524/440 |
| 5,286,407 | 2/1994 | Inoue et al. | 252/188.28 |
| 5,381,914 | 1/1995 | Koyama et al. | 215/348 |

FOREIGN PATENT DOCUMENTS

| | | |
|---|---|---|
| 0402217 A1 | 12/1990 | France . |
| 0546903 A1 | 6/1993 | France . |
| 54-46186 | 4/1979 | Japan . |
| 4-90848 | 3/1992 | Japan . |
| 5-97163 | 4/1993 | Japan . |
| WO9212004 | 7/1992 | WIPO . |

*Primary Examiner*—Rena L. Dye
*Attorney, Agent, or Firm*—Ratner & Prestia

[57] ABSTRACT

A container cap having a base portion, a substantially cylindrical portion extending perpendicularly from a perimeter of the base portion to define an inner surface of the container cap, and an uncovered liner disposed directly on the inner surface of the container cap, the liner having an oxygen absorbent dispersed therein. The container cap is adapted to seal an opening in a container and to absorb oxygen within the container. Also disclosed is a method for removing oxygen from a container by dispersing an oxygen absorbent in a liner, attaching the uncovered liner directly to an inner surface of a container cap without a separate adhesive, and placing the cap over an opening in the container such that the liner in the container cap seals the opening and absorbs oxygen within the container.

4 Claims, 2 Drawing Sheets

OXYGEN ABSORBING CONTAINER CAP LINER

This application is a continuation of application Ser. No. 08/695,542 filed Aug. 12, 1996, now abandoned, and Ser. No. 08/471,573 filed Jun. 6, 1995 now abandoned.

FIELD OF THE INVENTION

This invention relates in general to oxygen absorbents. It relates in particular to an oxygen absorbent dispersed in a liner of a container cap.

BACKGROUND OF THE INVENTION

Many products are susceptible to putrefaction, denaturation, mold growth, spoilage, rancidity, oxidation, or other deterioration when brought into contact with oxygen. Examples of such products include beer, wine, juice, vinegar, sauces, seasonings, processed foods, bread, produce, meats, and certain pharmaceuticals and chemicals, among a variety of others. Preservation of such products is disturbed when molds, bacteria, and other organisms that thrive in the presence of oxygen are present. These organisms cause the putrefaction and change in the taste or quality of the product. In addition, some of the products themselves are liable to be affected by oxidation that changes the taste or quality of the product. To prevent such oxidation and growth of organisms and thus increase the preservation stability of these products, the oxygen must be removed from the container in which the products are stored.

One technique for avoiding or reducing the presence of oxygen is vacuum packing. This involves evacuating a container before charging it with the product. Another technique is gas displacement. Here, an inert gas such as nitrogen is used to displace the air and hence the oxygen in a container. The displacement can be performed before or after the product is charged to the container.

Still another technique is a foaming method. Particularly applicable to products such as beer, a jet foamer can be used to inject a small amount of pressurized water to foam the beer after charging it to the container. The foam acts as a mechanical deoxygenizer, forcing the oxygen from the container.

Common disadvantages associated with all of the above techniques are the requirement of large-scale apparatus and operation and the difficulty of removing oxygen dissolved in the product. Also, in general, these techniques leave between 0.2% and 5.0% of the oxygen in the container. This amount of oxygen in the container is enough to adversely affect most products.

A simpler, more efficient technique for oxygen removal involves placing an oxygen absorbent in the container with the product. For this purpose, it is known to attach an oxygen absorbent to the underside of a container cap. For example, in U.S. Pat. No. 4,287,995, issued to Moriya, an oxygen absorbent is placed on the underside of a cap. The oxygen absorbent is held in place by a cover layer of gas permeable film that prevents contact between the absorbent and the contents of the container.

U.S. Pat. No. 5,143,763, issued to Yamada et al., discloses a multi-layer composition adapted to be attached to a liner on the underside of a container cap. The layers of the composition include (1) an adhesive layer that attaches the multi-layer structure to the cap liner, (2) an oxygen absorbing layer consisting of an oxygen absorbent dispersed in a resin, and (3) an oxygen permeable film layer covering the absorbent layer. The oxygen permeable film layer prevents the oxygen absorbent from leaching out from the resin into the contents of the container. The adhesive layer is disposed between the cap liner and the oxygen absorbing layer, completely separating the cap liner from the oxygen absorbing layer.

U.S. Pat. No. 5,274,024, issued to Koyama et al., also discloses a multi-layer composition adapted to be attached to the underside of a container cap. The patent discloses an adhesive layer, used to attach an oxygen absorbent layer to the cap, and an outer layer over the oxygen absorbing layer. The outer layer prevents direct contact between container contents and the oxygen absorbent. Again, the adhesive layer is disposed between the cap and the oxygen absorbent layer, completely separating the cap from the oxygen absorbent layer.

In all of the known devices, however, separate layers are used to accomplish the functions of lining the container cap, adhering the oxygen absorbent to the cap, absorbing the oxygen, and covering the oxygen absorber to prevent it from contacting the contents within the container.

SUMMARY OF THE INVENTION

The present invention provides a container cap having a base portion, a substantially cylindrical portion extending perpendicularly from a perimeter of the base portion to define an inner surface of the container cap, and an uncovered liner disposed directly on the inner surface of the container cap, the liner having an oxygen absorbent dispersed therein. The container cap is adapted to seal an opening in a container and to absorb oxygen within the container.

The present invention also provides a method for removing oxygen from a container by dispersing an oxygen absorbent in a liner, attaching the liner directly to an inner surface of a container cap, and placing the cap over an opening in the container such that the liner in the container cap seals the opening and absorbs oxygen within the container.

DETAILED DESCRIPTION OF THE INVENTION

The present invention provides an oxygen absorbing cap with an oxygen absorbent dispersed in a liner of the cap, the liner being directly attached to the inside surface of the cap. No cover layer is used over the liner. When such a cap is secured to a container, the oxygen absorbing liner in the cap acts both as a sealant, providing a seal between the cap and the container, and as an oxygen absorber, removing oxygen from inside the container.

Figure 1:
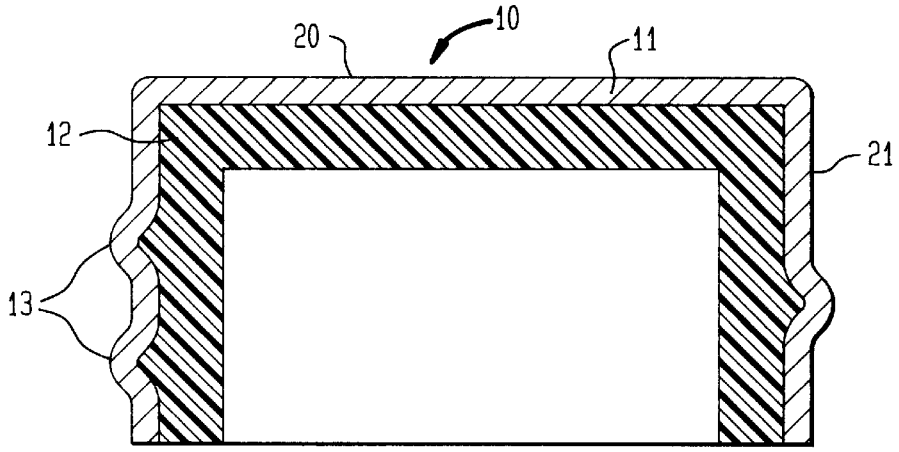
FIG. 1 is a cross-sectional side view of an oxygen absorbing container cap in accordance with an exemplary embodiment of the present invention.

FIG. 1 shows a side view of an exemplary embodiment of the present invention. Cap 11 includes a base portion 20 and a cylindrical portion 21 that is typically integrally formed with base portion 20. Cap 11 may be a plastic material, such as polyvinylchloride, polystyrene, or polycarbonate. Cap 11 may also be a metallic material, such as aluminum or iron. Grooves 13 are formed on the inner surface of cap 11 to mate with threads on a container opening (not shown).

Liner 12 is disposed on the inner surface of cap 11. Liner 12 in the illustrated embodiment includes a carrier resin with an oxygen absorbing material dispersed therein.

The oxygen absorbing materials useful in the present invention include iron, solid electrolytic salts, and glucose oxidase. The iron may be hydrogen-reduced iron, electrolytically reduced iron, or chemically reduced iron. Although iron is preferred as the metallic oxygen absorbing agent, it will be appreciated that other metals may be used. These are, by way of example and not limitation, aluminum, copper, zinc, titanium, magnesium, and tin. These other materials do not, however, absorb oxygen as fast as iron or have its oxygen absorbing capacity. Also, other elements which can be used in elemental or partially oxidized form are sodium, manganese, iodine, sulfur, and phosphorous. These elements are also not as effective as iron because they do not have the oxygen absorbing capacity of iron, the rate of oxygen absorption of iron, or both. The oxygen absorbing salt may be sodium chloride or any other suitable food compatible salt including, but not limited to, sodium sulfate, potassium chloride, ammonium chloride, ammonium sulfate, calcium chloride, sodium phosphate, calcium phosphate, and magnesium chloride. For non-food products, other non-food compatible salts may be used.

A carrier resin for the oxygen absorbing material is preferably polyvinylchloride plastisol. Polyvinylchloride plastisol is a known resin for lining the inner surface of container caps. Other resins that may be used as the carrier resin for the oxygen absorbing material and can also serve as suitable sealants include, without limitation, high density polypropylene, high density polyethylene, acrylic, vinyl acetate ethylene copolymer, ethylene vinyl acetate, vinyl acetate homopolymer, acetate ethylene copolymer, plasticized vinyl chloride, oxidized polyethylene homopolymer, and polyurethane. When polyvinylchloride plastisol is used as the carrier resin, up to 75% by weight of liner 12 may be 200 mesh iron, a preferred oxygen absorbent.

Figure 2:
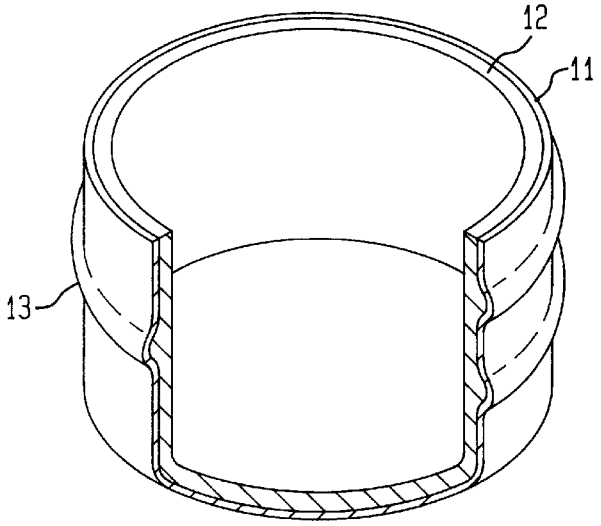
FIG. 2 is a perspective view in partial cross-section of an oxygen absorbing container cap in accordance with an exemplary embodiment of the present invention.

Liner 12 is prepared by dispersing the oxygen absorbents within the carrier resin (in a viscous liquid state) by mixing in an electric, high-speed mixer. Liner 12 is then sprayed onto the inner surface of cap 11 in liquid form according to methods known in the art. Liner 12 adheres to cap 11. Cap 11 and liner 12 are then heated (to about 400° F. for 2½ minutes) to solidify liner 12. FIG. 2 is a perspective view showing liner 12 coated on the inner surface of cap 11.

Figure 3:
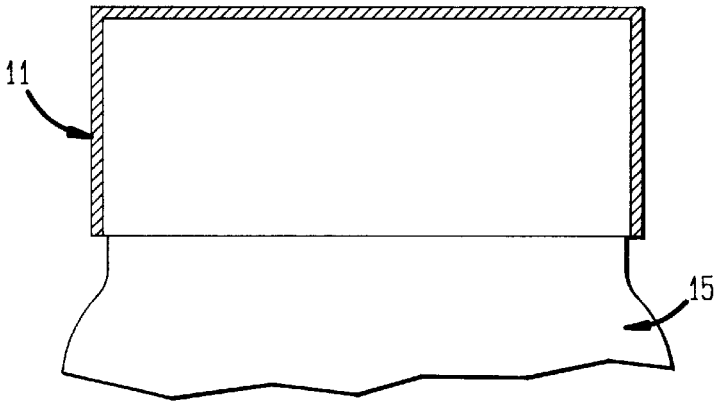
FIG. 3 is a partially cross-sectional side view of an oxygen absorbing container cap attached to a container in accordance with an exemplary embodiment of the present invention.

Cap 11 is attached to a container by first heating cap 11 until liner 12 softens. Cap 11 is then threaded onto the container, forming threads in liner 12 corresponding to grooves 13 in cylindrical portion 21 of cap 11. As shown in FIG. 3, cap 11 securely fits over the opening of container 15. Liner 12 seals cap 11 to container 15. Thus, liner 12 insures a tight fit between cap 11 and container 15 and facilitates the sealing function.

In addition, liner 12 absorbs oxygen within container 15 without the need for additional layers, such as cover layers or adhesive layers. The invention provides an economical and practical method for absorbing oxygen within a container by combining the adhesive function (affixing liner 12 to cap 11), the oxygen absorbing function, and the container sealing function in a single element: liner 12.

Figure 4:
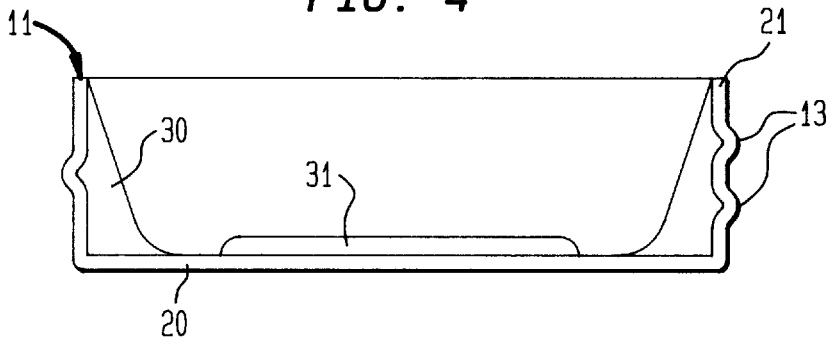
FIG. 4 is a cross-sectional side view of an oxygen absorbing cap in accordance with another exemplary embodiment of the present invention.

FIG. 4 is a side view of an alternative embodiment of the present invention. In the illustrated embodiment, cap 11 has a peripheral liner 30 disposed around the intersection of base portion 20 and cylindrical portion 21. Peripheral liner 30 extends over grooves 13 such that grooves will be formed in peripheral liner 30 as cap 11 is attached to a container. This ensures sealing cap 11 to the container. Peripheral liner 30 does not include an oxygen absorbent.

The embodiment illustrated in FIG. 4 also includes a central liner 31. Central liner 31 is disposed on the inner surface of base portion 20. Central liner 31 is centrally disposed and circular in the illustrated embodiment, but any shape or thickness may be used. Central liner 31 contains an oxygen absorbent that absorbs oxygen within the container to which cap 11 is attached. The oxygen absorbent is dispersed in central liner 31 as discussed above. Peripheral liner 30 and central liner 31 are both sprayed into cap 11 according to methods known in the art, and then heated to solidify.

Figure 5:
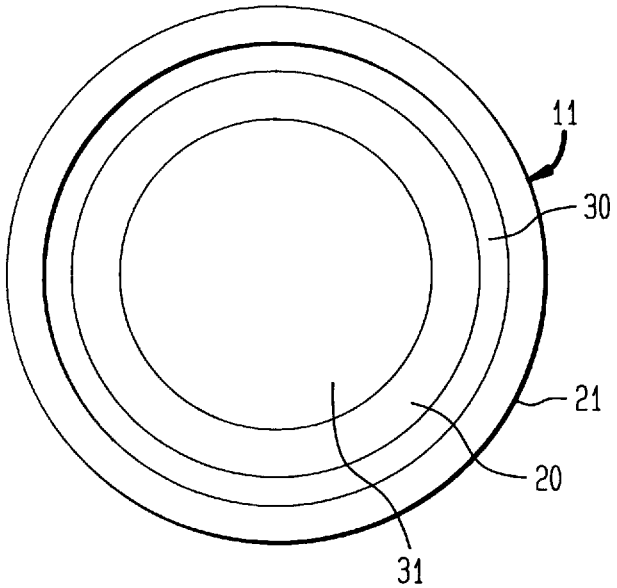
FIG. 5 is a top view of the embodiment shown in FIG. 4.

FIG. 5 is a top view of the embodiment illustrated in FIG. 4. This embodiment conserves both the carrier resin material used for the liners and the oxygen absorbents.

The following examples are presented to illustrate the present invention; they are not intended to limit it.

EXAMPLE 1

Polyvinylchloride plastisol in an amount of 10.35 grams was blended with 12.51 grams of 200 mesh iron containing 2% sodium chloride. The blending was done in an electric, high-speed mixer. A sample of the resulting liner material was coated on the inner surface of a container cap. The container cap was placed in a 500 cc mason jar containing 100 cc of oxygen. A one-eighth-inch hole was drilled in the lid of the mason jar with a septum placed over the hole to prevent oxygen from leaking in to the container. The container was left at room temperature at 100% relative humidity within the jar, and the amount of oxygen absorbed over time by the cap liner was measured. This procedure was repeated two times using different weights of liner material inside the cap. The results are tabulated below.

| | Oxygen Absorbed Over Time (cc) | | | |
|---|---|---|---|---|
| Time | Sample #1 (1.47 gms*) | Sample #2 (1.71 gms*) | Sample #3 (1.51 gms*) | Average (1.56 gms*) |
| 22 hrs | 10 | 10 | 10 | 10 |
| 46 hrs | 15 | 14 | 15 | 15 |
| 96 hrs | 24 | 22 | 24 | 23 |
| 184 hrs | 37 | 32 | 34 | 34 |
| 234 hrs | 37 | 32 | 37 | 35 |
| 330 hrs | 51 | 41 | 48 | 47 |

*Weight of liner coated on inner surface of cap.

EXAMPLE 2

Polyvinylchloride plastisol in an amount of 8.40 grams was blended with 5.17 grams of 200 mesh iron containing 2% sodium chloride in an electric, high-speed mixer. A sample of the resulting liner composition was coated on the inner surface of a container cap, which was placed in a 500 cc mason jar containing 100 cc of oxygen. A one-eighth-inch hole was drilled in the lid of the mason jar with a septum placed over the hole to prevent oxygen from leaking in to the container. The container was left at room temperature at 100% relative humidity within the jar, and the amount of oxygen absorbed by the liner over time was measured. The procedure was repeated two times using different weight samples of liner within the cap. The results are tabulated below.

Oxygen Absorbed Over Time (cc)

| Time | Sample #1 (1.47 gms*) | Sample #2 (1.71 gms*) | Sample #3 (1.51 gms*) | Average (1.56 gms*) |
|---|---|---|---|---|
| 22 hrs | 8 | 8 | 8 | 8 |
| 46 hrs | 12 | 12 | 12 | 12 |
| 96 hrs | 26 | 19 | 21 | 22 |
| 184 hrs | 46 | 30 | 30 | 35 |
| 234 hrs | 52 | 33 | 30 | 38 |
| 330 hrs | 61 | 43 | 41 | 48 |

*Weight of liner coated on inner surface of cap.

The results of both Examples 1 and 2 show good oxygen absorption using the present invention. Using the invention, the results are achieved with reduced material and fabrication time.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A container cap comprising:

a base portion having a perimeter;

a substantially cylindrical portion extending perpendicularly from said perimeter of said base portion and defining an inner surface of said container cap; and an entirely uncovered resin liner disposed in direct contact with said inner surface of said container cap and adhered to said inner surface with sufficient contact force to avoid additional mechanical sealing mechanisms, said liner having an oxygen absorbent dispersed throughout, whereby said container cap is adapted to seal an opening in a container and to absorb oxygen within said container.

2. A container cap as claimed in claim 1 wherein said oxygen absorbent is selected from the group consisting of iron, aluminum, copper, zinc, titanium, magnesium, tin, sodium, manganese, iodine, sulphur, phosphorus, sodium chloride, sodium sulfate, potassium chloride, ammonium chloride, ammonium sulfate, calcium chloride, sodium phosphate, calcium phosphate, glucose oxidase, and magnesium chloride.

3. A container cap as claimed in claim 1 wherein said oxygen absorbent is 200 mesh iron.

4. A container cap as claimed in claim 1, wherein said resin liner is polyvinylchloride plastisol.

* * * * *